United States Patent [19]

Maccaferri

[11] Patent Number: 4,610,404

[45] Date of Patent: Sep. 9, 1986

[54] ROBOT DEVICE FOR LOADING AND UNLOADING SPOOLS IN WIRE WINDING MACHINES

[75] Inventor: Angelo Maccaferri, Bologna, Italy

[73] Assignee: S.A.M.P. S.p.A. Meccanica di Precisione, Bologna, Italy

[21] Appl. No.: 673,062

[22] Filed: Nov. 19, 1984

[30] Foreign Application Priority Data

Nov. 18, 1983 [IT] Italy ..... 12678 A/83

[51] Int. Cl.[4] ..... B65H 54/00; B65H 54/02

[52] U.S. Cl. ..... 242/25 R; 242/35.5 A

[58] Field of Search ..... 242/35.5 A, 35.5 T, 242/35.5 R, 25 A, 25 R, 18 A; 57/270, 281, 266, 268; 414/736, 222, 749, 744 R

[56] References Cited

U.S. PATENT DOCUMENTS

| | | | |
|---|---|---|---|
| 3,822,044 | 7/1974 | Riekkinen | 57/281 X |
| 4,023,743 | 5/1977 | Schippers | 57/268 X |
| 4,205,427 | 6/1980 | Koch et al. | 414/736 X |
| 4,351,494 | 9/1982 | Schippers et al. | 57/270 X |

FOREIGN PATENT DOCUMENTS

| | | | |
|---|---|---|---|
| 0110275 | 6/1984 | European Pat. Off. | 242/35.5 A |
| 3018628 | 6/1982 | Fed. Rep. of Germany . | |
| 2080846 | 2/1982 | United Kingdom . | |

*Primary Examiner*—Stuart S. Levy

*Assistant Examiner*—Lynn M. Sohacki

*Attorney, Agent, or Firm*—Pollock, Vande Sande & Priddy

[57] ABSTRACT

Robot device for the loading of empty spools (Z') and the unloading of filled spools (Z) respectively into and from wire winding machines (B, B', B'') aligned in a single file on one side of a track (A), comprising a carriage (1) which moves along the track and stops at the machine to be served. The carriage (1) carries a vertical supporting structure (23) onto which there are mounted two brackets (51, 51') vertically movable and rotatable around the supporting structure (23). A slide (17) which moves in a direction transverse to the movement of the carriage (1) serves for introducing one of the brackets (51,51') into the winding machine, where the bracket is then lifted to receive the filled spool from the winding machine, or to load an empty spool onto the winding machine. On a platform (24) located on top of the supporting structure (23) there are arranged the central power and control unit (25), the distribution unit and the electric and electronic apparatus for controlling the various motion devices of the robot, as well as the device (77) for cutting the wire (M) being fed to the filled spool and for holding the leading end of the cut wire, and the devices (61–73) for securing the trailing end of the cut wire to the filled spool, and the leading end of the cut wire to the core of the empty spool.

11 Claims, 19 Drawing Figures

Z
Z
Z
Z
24
49'
49
31
50
47
V
V
30
27
29
45'
41
43
44
45
41
27
28
151'
51'
2
16
1
15'
226
(26)
126
III
III
48
47'
48'
23
22
20
21
15
16
33
34
32
35
37
37'
38
36
42
151
17
2
A
51

Z
51
151
54
54
56'
(53)
56
55'
23
55
151

XII
60
57
59
60'
58
61
62
76
77
M
75
72
73
66
63
64
64'
65
65'
24

24
30
29
45'
57'
64'
46
73
62
64'
77
61
M
F1
Z
B''

ROBOT DEVICE FOR LOADING AND UNLOADING SPOOLS IN WIRE WINDING MACHINES

SUMMARY OF THE INVENTION

In the apparatus for the production of wire, it is known to align in a single file a plurality of wire winding machines, which present equal or different operational features, both in relation to the size of the spools and in relation to the section of the wires, in such a manner that said winding machines are arranged on one side of a rectilinear guide, with the winding axis which is arranged parallelly to the longitudinal axis of the mentioned guide, along which there moves a programmable robot which effects the loading of the empty spools and the unloading of the filled spools to and from the winding machines, taking the empty spools and depositing the filled spools from and into feeding and collecting stations which are usually located at one end of the said guide. The invention relates to a novel type of robot for effecting the above mentioned operations, which differs from similar robots of known type, due to a greater reliability, to the fact that it can operate on spools having diameter and weight which can vary within ample limits, to the fact that it presents reduced overall dimensions and to the fact that it presents a greater operational flexibility, particularly in the steps of taking of the empty spool and of discharge of the filled spool.

BRIEF DESCRIPTION OF THE DRAWINGS

The above and other features of the robot according to the invention, and the advantages deriving therefrom, will become evident from the following description of a preferred embodiment of same, illustrated by way of example in the accompanying drawings, in which.

DESCRIPTION OF THE PREFERRED EMBODIMENT

Figure 1:
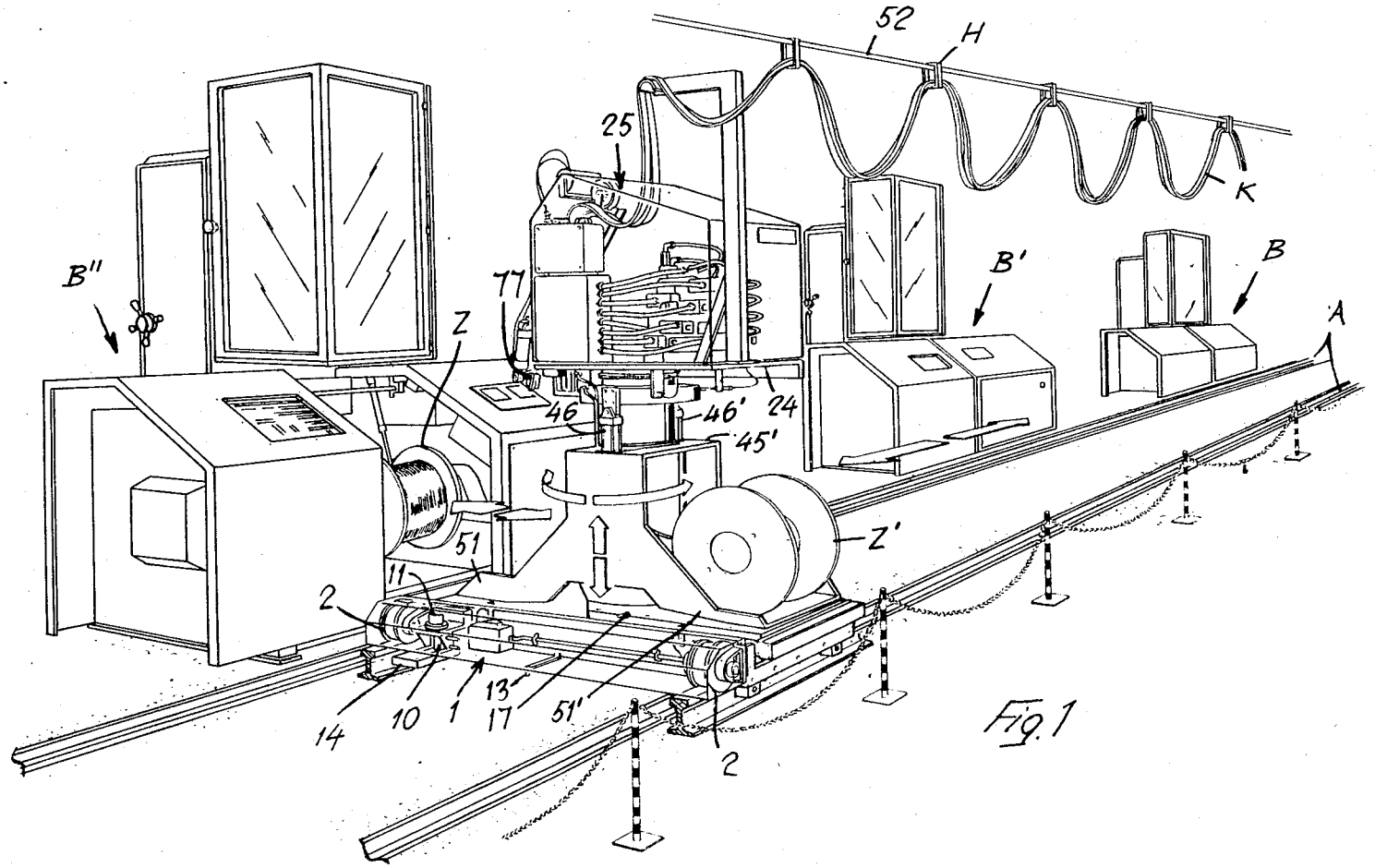
FIG. 1 shows in perspective view the robot positioned at a winding machine, and prepared to serve this latter.

Referring firstly to FIG. 1, reference letters B, B′, B″ indicate wire winding machines of non-automatic type, which may present identical or even different operational features, arranged on one side of the rectilinear track A upon which is shiftable, in a controlled manner, the robot according to the invention which automatically operates on the wire winding machine from which must be unloaded the filled spool and which consequently must be loaded with a new empty spool. The spools are arranged with their winding axes parallel to the longitudinal axis of the track A. The devices which provide for the loading of the robot with the empty spools having the required size, and the devices which discharge or receive from the said robot the filled spool cyclically unloaded from a wire winding machine, are usually arranged at one of the ends of the track A, in a manner which can be easily conceived and put into practice by persons skilled in the art, on the basis of the operational features of the robot which will appear from the following description.

Figure 2:
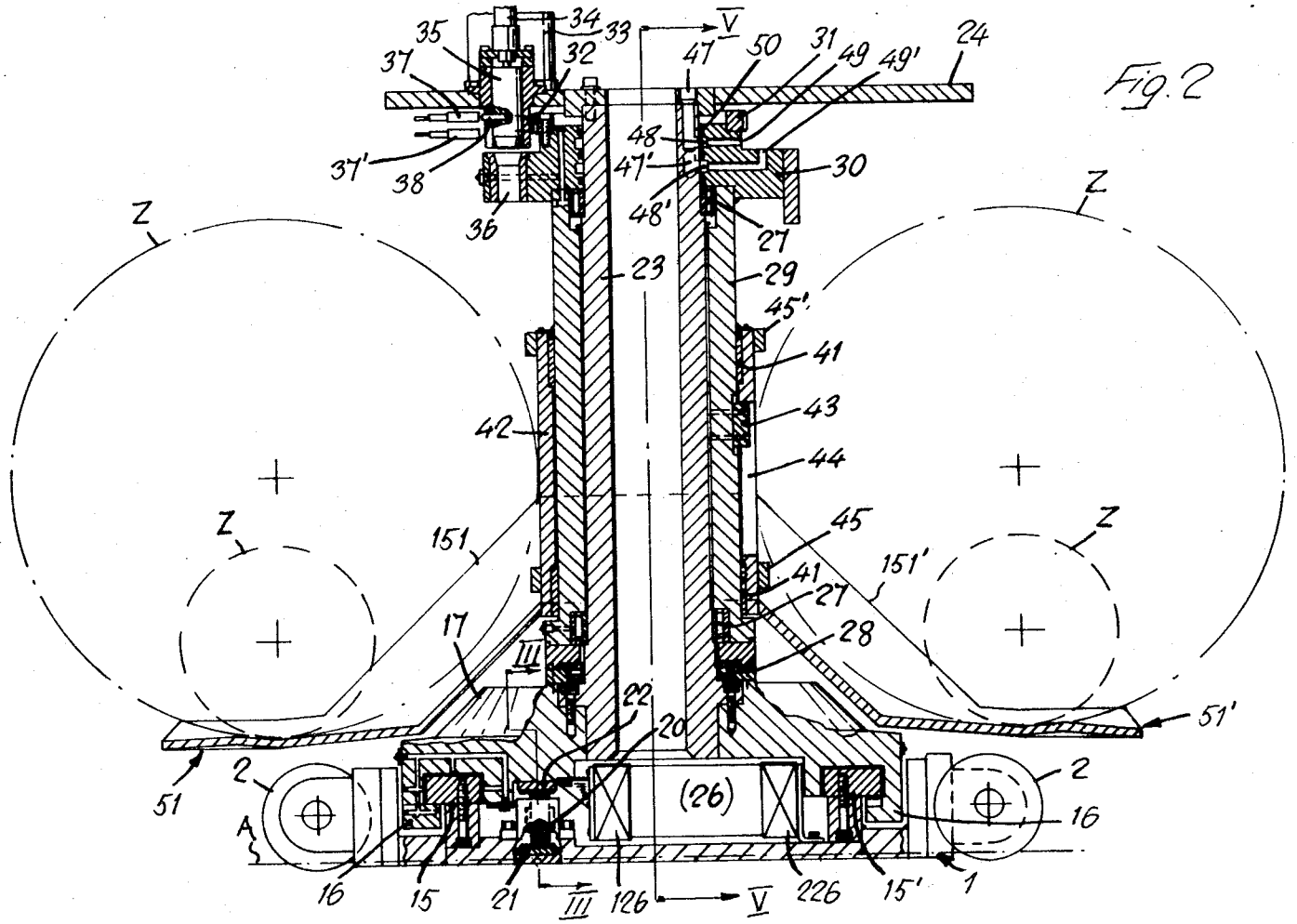
FIG. 2 shows a front elevation of the robot without the upper unit for the taking and cutting of the wire and without the unit for securing the trailing end and the leading end of the winding, the robot being sectioned along its height and along the length of the underlying carriage.
Figure 3:
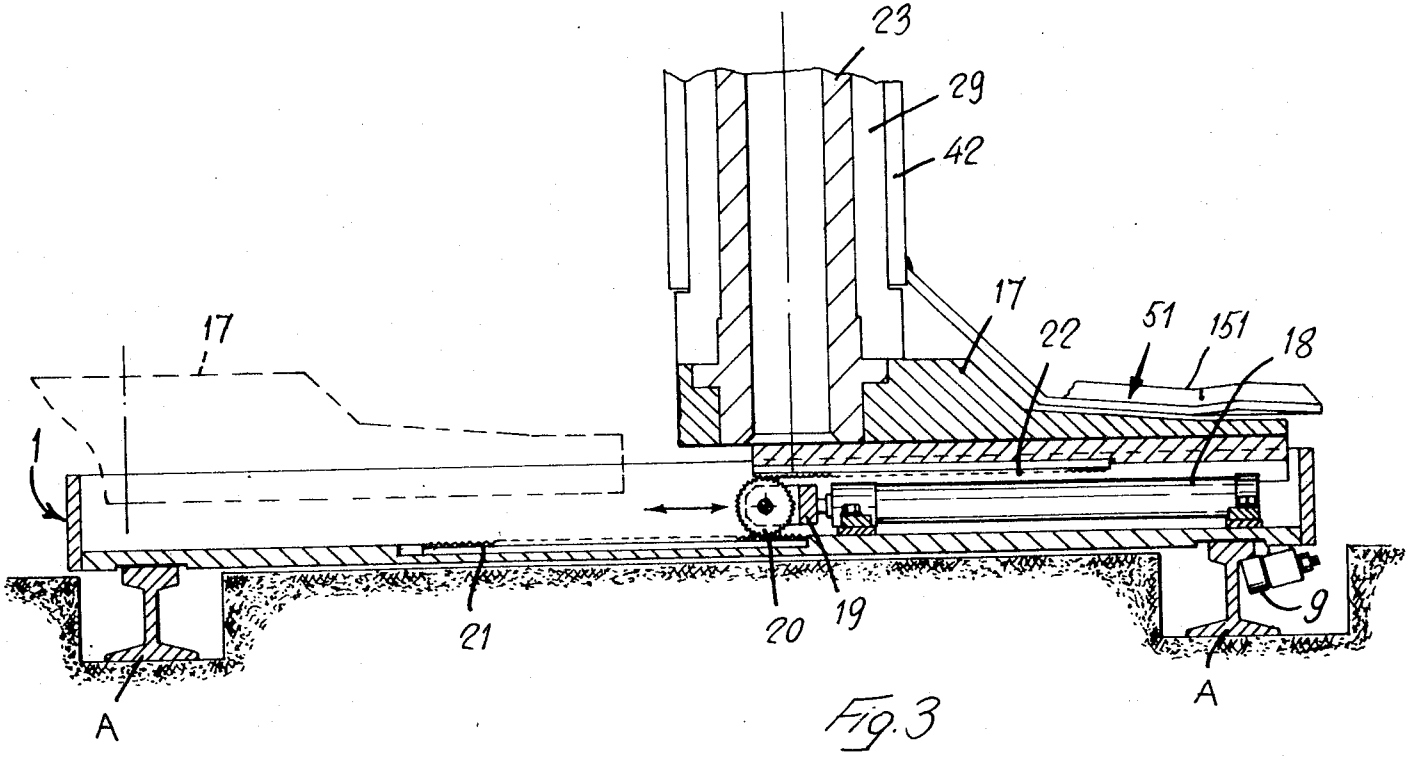
FIG. 3 shows the carriage of the robot, sectioned along line III—III of FIG. 2.
Figure 4:
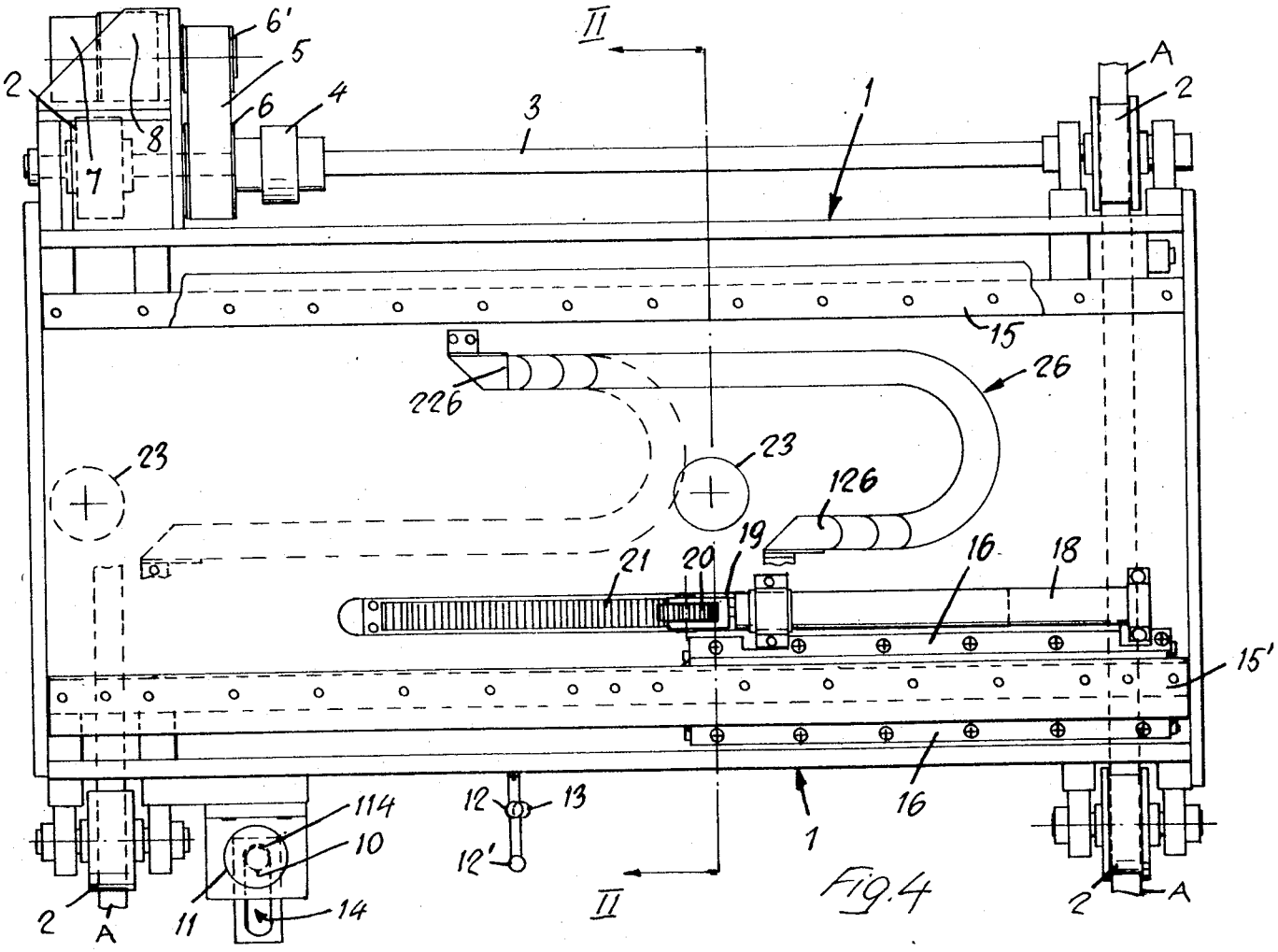
FIG. 4 shows the carriage of the robot in plan view.

From FIGS. 1, 2, 3 and 4 it can be noted that the robot comprises a carriage 1 provided with wheels 2 (of which some are flanged wheels) which carriage 1 moves on the track A, one pair of said wheels being connected by a shaft 3 provided with a flexible coupling 4 and which, through a positive drive consisting of a toothed belt 5 and of toothed pulleys 6–6′, is driven by a hydraulic motor 7 secured frontally on the carriage 1 by means of a bracket 8. In consideration of the fact that during the operation of the robot, the carriage 1 is loaded in such a manner as to be urged to swing upwardly by being fulcrumed on the rail which is next to the row of winding machines, this swinging motion is prevented by the fact that rollers 9 which are mounted freely rotatable on the carriage 1 cooperate with the outer flank of the other rail of the track A. In FIG. 4, reference numeral 10 indicates a vertical axis latch member which is mounted on one front of carriage 1 and is driven by a hydraulic jack 11, said latch member presenting a frusto-conical bottom end. Whenever the robot is located at the stations which provide for the loading and unloading onto and from the said robot, respectively of an empty spool and of a filled spool, the latch member 10 is lowered and cooperates with a conical seat (not shown) secured on the ground or to the flank of a rail of track A, the whole in such a manner that the various operational units located on carriage 1 come to be correctly positioned with respect to the said loading or unloading stations. Whenever the robot is called to serve a winding machine, the latch member 10 is lifted automatically, and motor 10 is actuated so as to move the carriage 1 on track A with accelerated motion, and thus transfer said carriage quickly to the winding machine which is to be served. Prior to reaching said winding machine, which in FIG. 1 is designated B", the carriage 1 cooperates with a fixed sensor (not shown) which promotes the slowing down of motor 7 so that the carriage approaches slowly the winding machine B" which is about to terminate or has terminated the winding operation and which has opened its hood in such a manner as to give access to the filled spool Z located therein. When the carriage 1 reaches a sensor 13 fixed on the ground (FIG. 4), said sensor 13 detects the first one of a pair of reference members 12, 12' secured to the carriage 1, and controls the stopping of motor 7 and subsequently the lowering of latch member 10 which enters a fixed slot-shaped seat 14 of predetermined length, arranged parallel to track A. Subsequently the motor 7 is again actuated in order to move slowly the carriage 1 in the opposite direction, until the sensor 13 detects the reference member 12, while the latch member 10 abuts against the end 114 of the said slot 14. The robot is thus correctly positioned with respect to the wire winding machine B".

Figure 6:
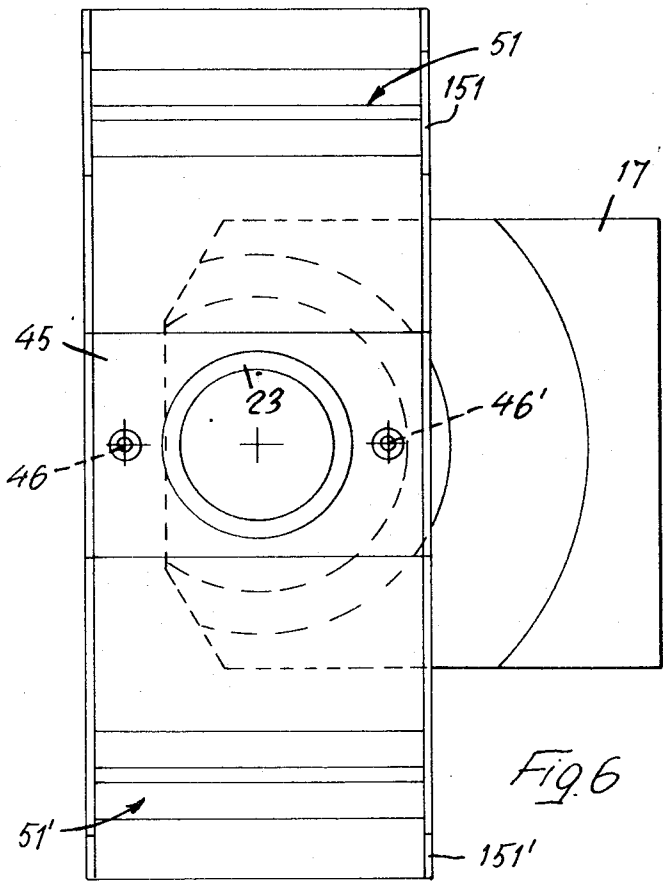
FIG. 6 is a plan view from the top of the brackets by means of which the robot supports the spools, and also shows the slide which carries said brackets.

On carriage 1 there are secured, at right angles with respect to track A, a pair of rectilinear, parallel and horizontal guides 15, 15' presenting an inverted "L" or a "T" section, and onto which there is slidably mounted a slide 17 (see also FIG. 6) by means of sliding shoes 16 which cooperate with said guides on their upper, side and bottom surfaces, said slide 17 being in its rest position where indicated in full lines in FIG. 3 and being movable to the position indicated with dash lines in the same FIG. 3. In order to move slide 17 in alternate directions, there is provided a piston and cylinder assembly 18 (FIG. 3) secured by its cylinder to the carriage 1, parallel to the guides 15, 15', and carrying with its piston end a fork 19 onto which there is rotatably mounted a pinion 20 cooperating with a pair of superposed racks 21, 22 which are parallel to each other and are also parallel to the said guides 15, 15', one of said racks (21) being fixed to the carriage 1, while the other rack 22 is fixed to the slide 17. By this arrangement, the slide 17 can be moved along a path which is double the running path of the pinion 19, with all consequent advantages. On the end portion of the slide 17 which faces the wire winding machines there is obtained an opening inside which there is inserted by one of its ends, and flange-mounted, a tubular column 23 vertically arranged, and onto the upper end of which there is secured the horizontal platform 24. On said platform there is mounted the hydraulic power and control unit 25 (FIG. 1), and the electrovalves and the electrical and electronic apparatuses which are required for the programmed operation of the various motion devices carried by the robot. From the above mentioned control apparatuses, there departs a bundle of pipes (not shown in FIG. 2) which pass axially through column 23 in downward direction and are connected to the end 126, secured to slide 17, of a bundle of flexible pipes associated to a guide catenary 26 (FIG. 4) which by its other end 226 is secured to carriage 1 and serves for the power feeding of the piston and cylinder assembly 18, the hydraulic motor 7 and the hydraulic jack 11 of the latch member 10. On the column 23 there is rotatably mounted (FIG. 2), with the interposition of radial bearings 27 and of at least one axial bearing 28, a jacket 29 on the upper end of which there is secured a collar 30 which is located at a short distance from platform 24. A crown gear 31 is secured to collar 30, coaxially to the assembly 23, 29, said crown gear cooperating with a pinion 32 keyed on the shaft of a small hydraulic motor 33 which is fixedly mounted on platform 24, on said platform 24 there being also mounted a hydraulic jack 34 which actuates a conical and vertical latch member 35 adapted to cooperate with one of four conical seats 36 arranged angularly equispaced on said collar 30, the whole in such a manner as to guarantee a stable positioning to the mentioned components 29, 30 in the angular position into which they are sequentially brought by motor 33 (see after). The engagement or rest condition of the latch member 35 is sensed by proximity switches 37, 37' which sense the position of an appendix 38 laterally fixed to 35, while the angular position of the assembly 29, 30 is sensed by a proximity switch 39 (FIG. 9) carried by platform 24 and arranged along the rotational orbit of an appendix 40 laterally secured to collar 30. Similar devices are provided in order to detect the condition of the latch member 10 mounted on carriage 1. The driving of units 33 and 34 can be easily effected by the hydraulic control box and by the distribution units mounted on platform 24.

Figure 5:
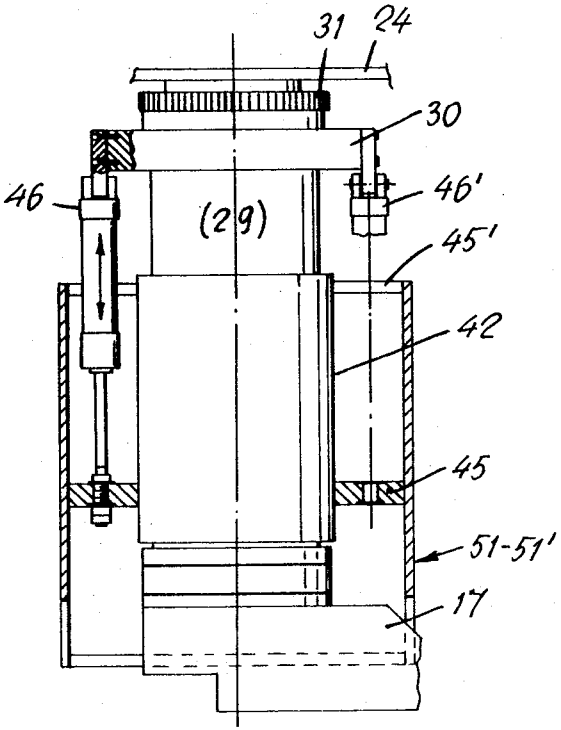
FIG. 5 shows some constructional details of the robot, taken along line V—V of FIG. 2.
Figure 9:
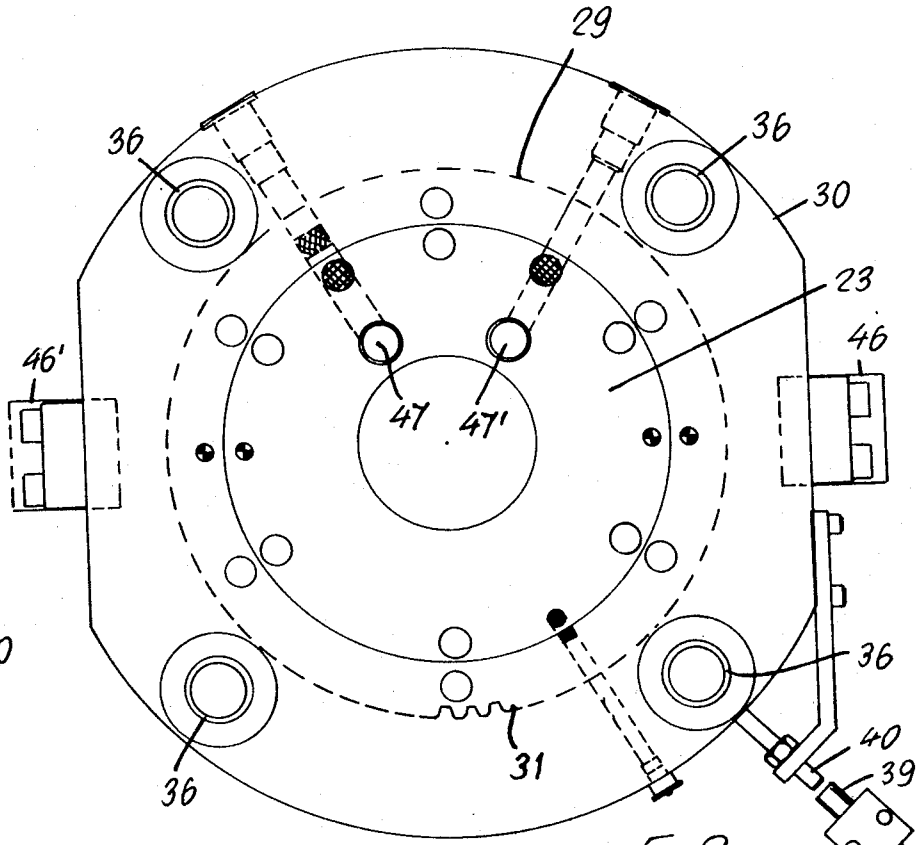
FIG. 9 shows some details of the upper portion of the upright structure of the robot, in plan view.
Figure 15:
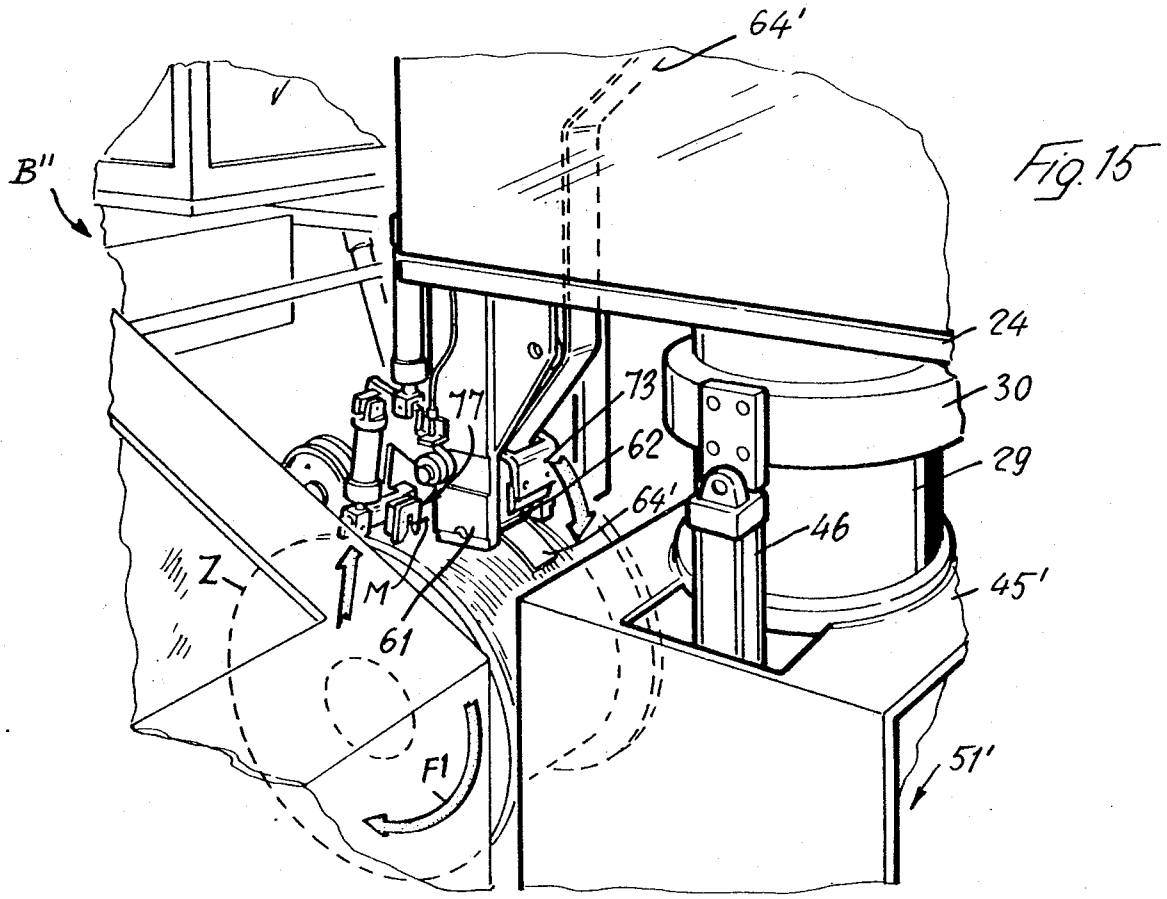
FIGS. 15, 16, 17, 18 and 19 show in perspective view the parts of interest of the robot during a series of working steps.
Figure 16:
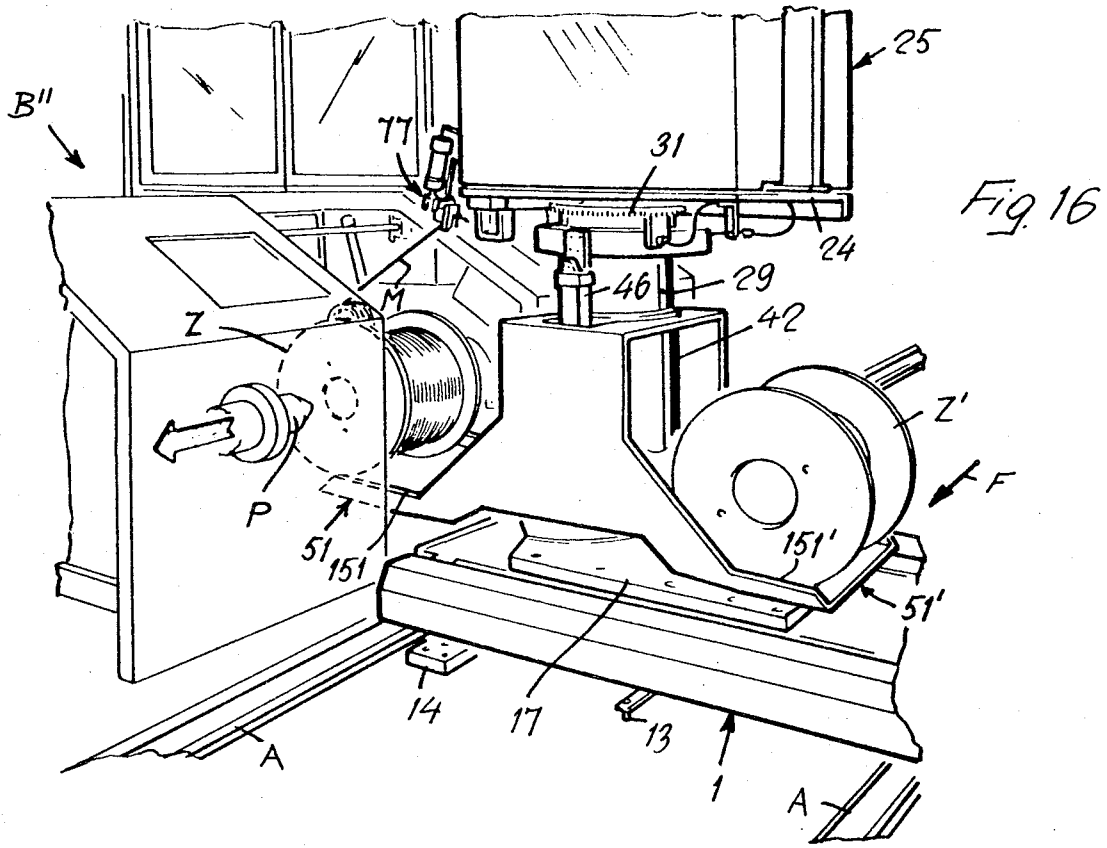
Figure 17:
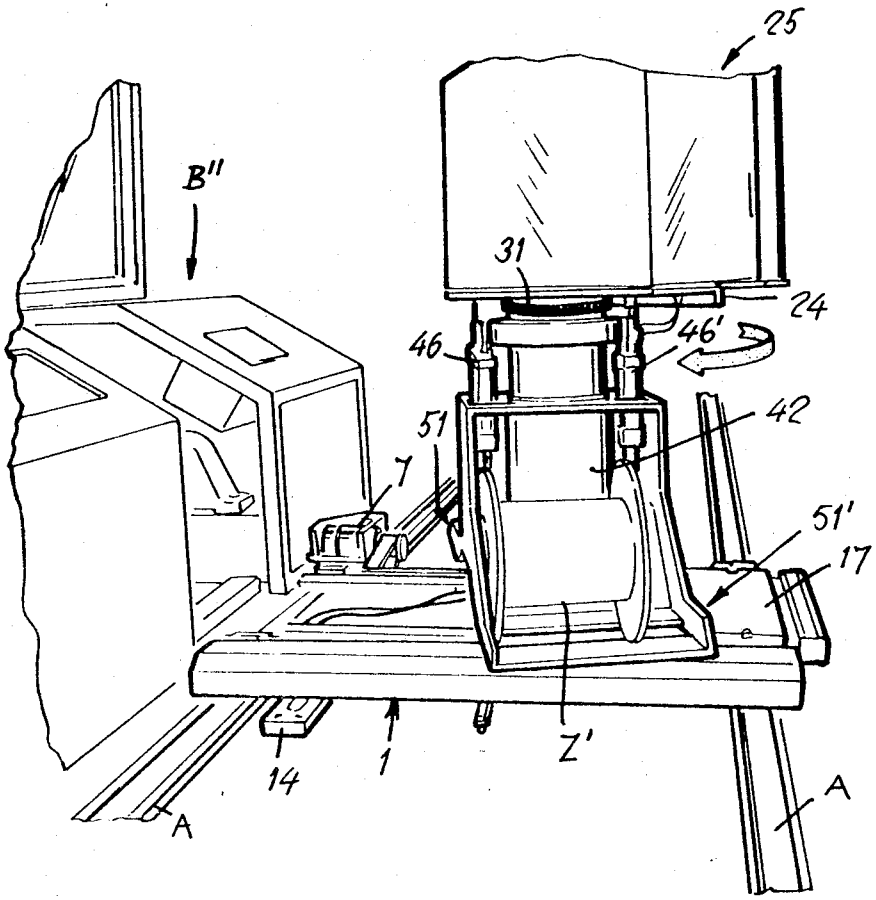
Figure 18:
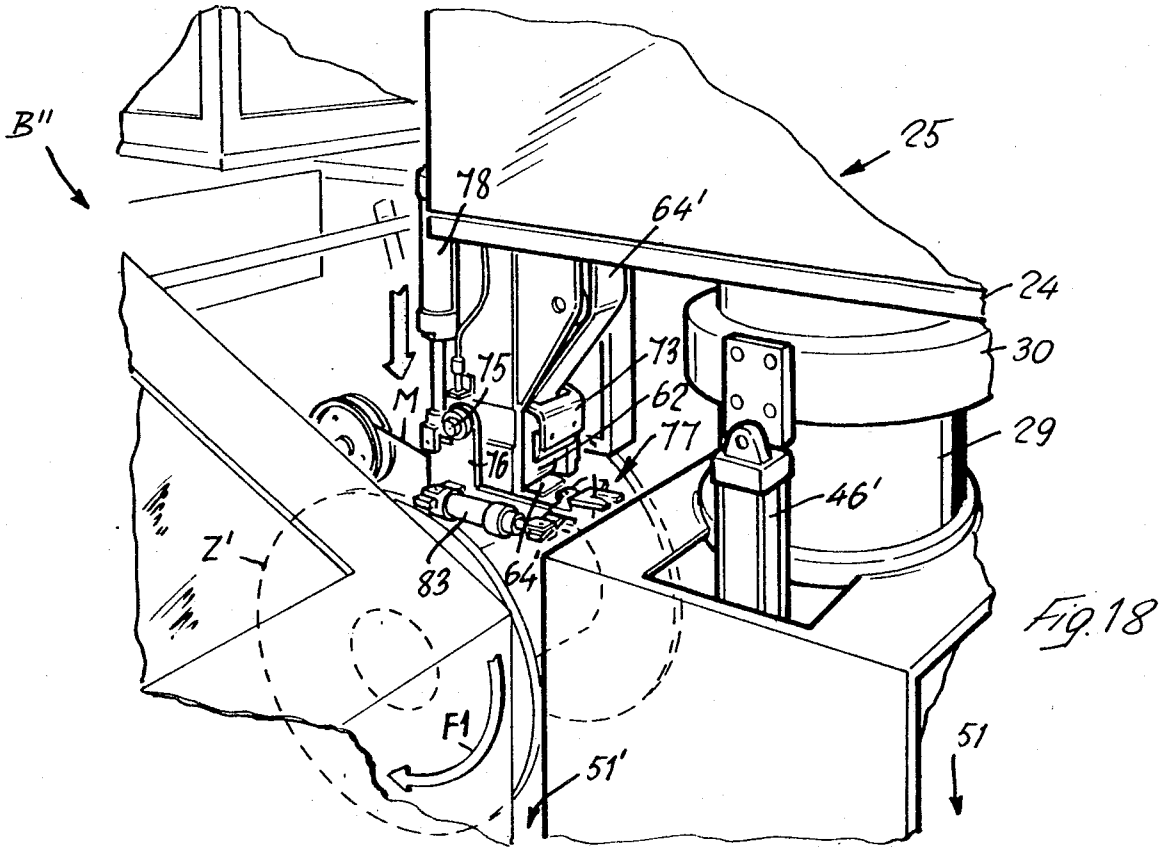
Figure 19:
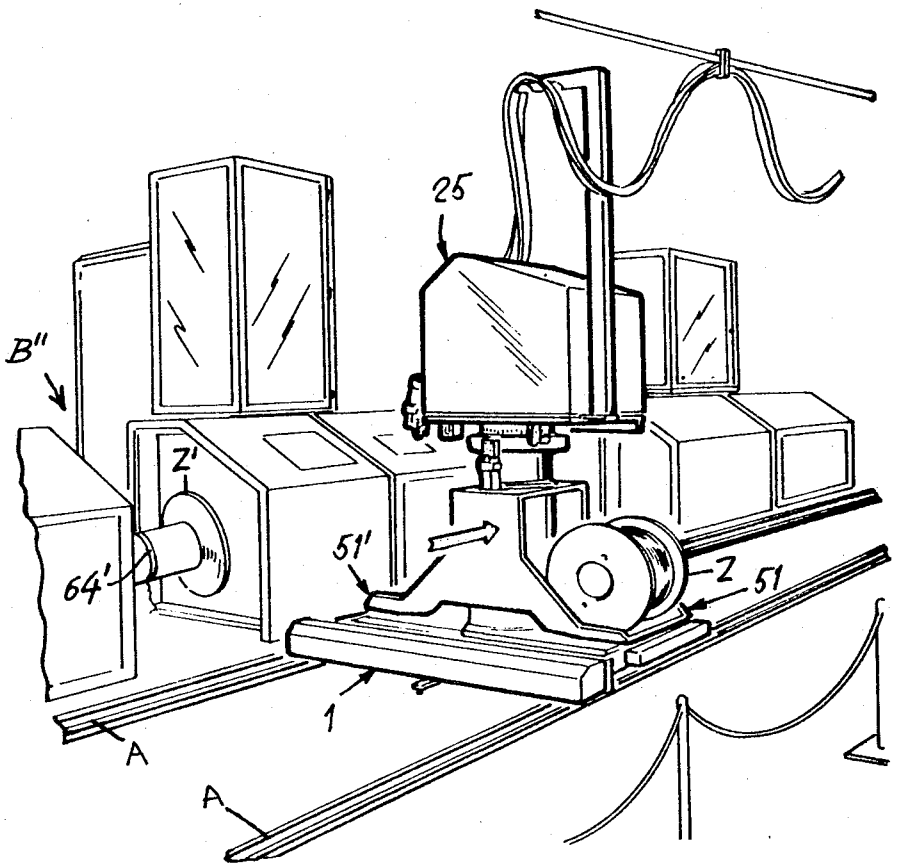

On jacket 29 (FIG. 2) there is mounted in axially shiftable but non-rotatable manner (thanks to the key and groove arrangement 43, 44) a sleeve 42 provided at its inner ends with bushings 41 made of material presenting a low friction coefficient. By making reference also to FIGS. 5 and 6, it can be noted that on the lower section of sleeve 42 there is secured the central portion of a horizontal and rectangular plate 45. To the side portions of said plate 45 which project laterally of said sleeve there are secured, in symmetric arrangement, the stems of a pair of double-acting hydraulic jacks 46–46' which are vertically directed and are secured by their cylinder bodies to the collar 30. These jacks provide for the axial movement, along jacket 29, of the sleeve 42 and of the parts associated thereto. With reference to FIGS. 2 and 9, it can be noted that the hydrauilc jacks 46–46' are connected to the hydraulic control unit and distribution units arranged on platform 24 by means of ducts 47–47' obtained longitudinally in column 23 and opening into annular recesses 48–48' at different heights on the inner side surface of collar 30. Ducts 49–49' depart from said recesses for the feeding and discharge of the above mentioned jacks, while annular packings 50 provide for the tight sealing of said circuits. The horizontal plate 45 is fixed by its ends to the parallel sides of two identical brackets 51–51' cantilevered in opposite arrangement to the lower portion of sleeve 42, and which present longitudinally the profile shown in FIG. 2, with a shallow concave supporting bottom, and with side edges 151–151', designed in such a manner that each bracket (51–51') can safely support and carry a spool Z. A further strengthening plate 45' is secured to the upper portion of sleeve 42 and to the top portions of the sides of the two brackets 51–51' so as to structurally strengthen and stiffen the whole assembly. When the robot reaches the wire winding machine B" to be served, the brackets 51–51' are directed at right angles with respect to the track A and the bracket 51' which is not facing the winding machine carries an empty spool Z' which has been loaded from the loading station at one end of track A. The brackets 51–51' are in their lowered position (the stems of the jacks 46–46' are fully expanded) and the slide 17 is in its rest position, as indicated in full lines in FIG. 3. When the carriage 1 has been correctly positioned with respect to the wire winding machine B" and the said winding machine has completed its working cycle (and the protective hood has been opened, as shown in FIG. 1), the slide 17 is moved towards the said winding machine so as to position the bracket 51 below the filled spool Z, without interfering with said spool. At this moment (FIG. 15), there takes place the intervention of suitable means (which will be described hereinbelow) which in correct time relationship effect the cutting of the wire which is directed to the filled spool Z, hold the leading end of said wire and secure the trailing end of the wound wire onto the winding or coil, by applying on this latter a piece of adhesive tape. Subsequently, the brackets 51–51' are lifted, as shown in FIG. 16, so that the bracket 51 is positioned a short distance from the spool Z, arranged with its side edges 151 laterally and at the exterior of the flanges of spool Z. For this purpose there are provided sensor means which are capable of sensing the position of the bracket 51 with respect to the flanges of the spool Z. In correct time relationship, the filled spool Z is freed from the center or tailstock P. Subsequently, the robot moves on track A in the direction indicated by arrow F in FIG. 15, for a short run having a length which is equal to the length of the slot 14 (see FIG. 4), the whole in such a manner that thanks to the engagement of the side edges 151 of bracket 51 with the flanges of the filled spool Z, this latter is extracted from the center or tailstock of the winding machine. At this point, the slide 17 is moved away from the winding machine B" and is brought into the cycle starting position, in such a manner that the bracket 51 loaded with the filled spool Z is brought clear off the hood of the winding machine B". Thereafter, as shown in FIG. 17, the latch member 35 (FIG. 2) is lifted and motor 33 is actuated so that the brackets 51–51' are rotated 180° around column 23, thus inverting their respective positions. The motor 33 is then stopped and the latch member 35 returns to its locking position. The slide is now again moved near to the winding machine B" so that the bracket 51' positions the empty spool Z' between the center and the tailstock of said winding machine (FIG. 18). Thereafter the robot moves on track A in the direction of movement of the tailstock of the winding machine B" so as to promote the taking up of the spool Z' by the centering and driving means of the said winding machine, and subsequently the bracket assembly 51–51' is lowered. At this point, there takes place the intervention of the devices mounted on platform 24 (and which will be described hereinbelow) which secure the leading end of the wire to be wound, on the core of the empty spool Z'. Subsequently the latch member 10 (FIG. 4) is lifted and the motor 7 is actuated. The robot (see FIG. 19) moves away from the winding machine which has been served and returns to the extremity of track A where the filed spool Z extracted from B" will be unloaded and the bracket 51' will be loaded with another empty spool. From FIG. 1 it can be noted that above and parallelly to track A there is arranged a guide 52 which by means of movable trolleys H supports the bundle of cables K serving for the feeding and the automatic and programmed operation of the robot.

Figure 7:
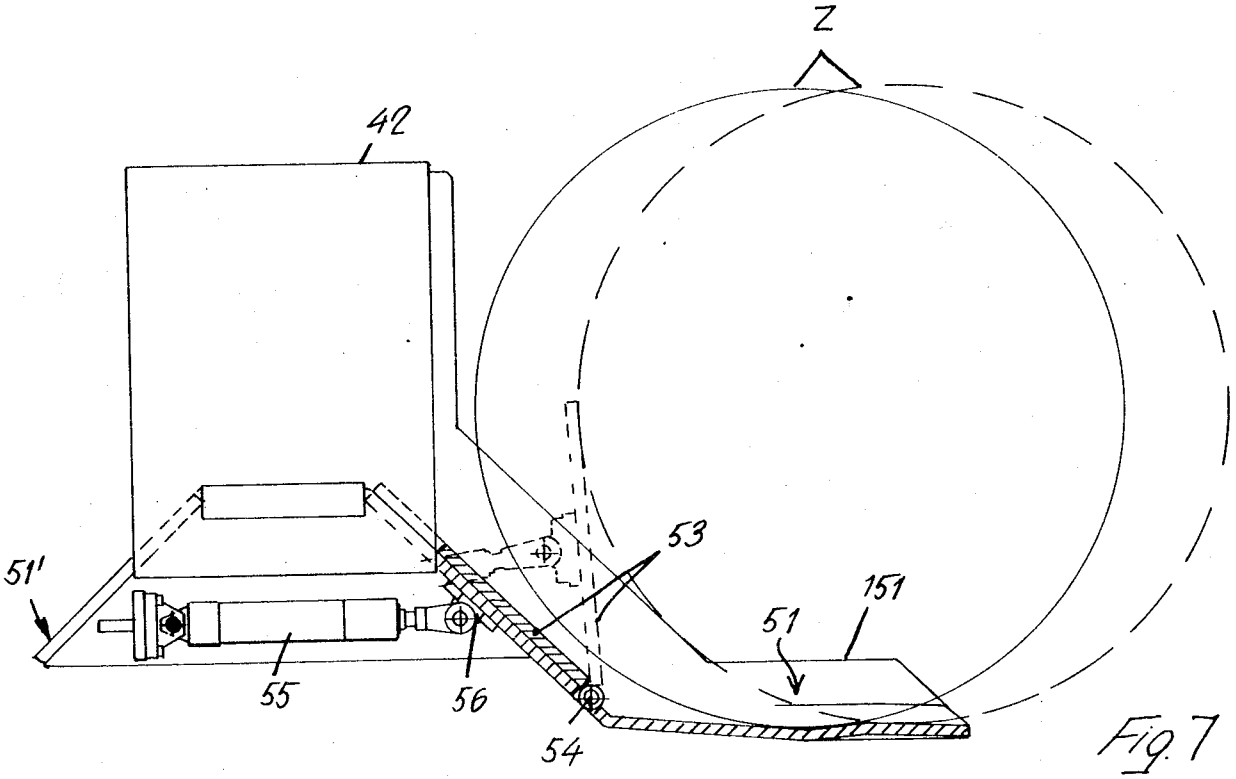
FIG. 7 is a side view of a discharge mechanism which may be associated to the bracket of the robot and which will carry the filled spool.
Figure 8:
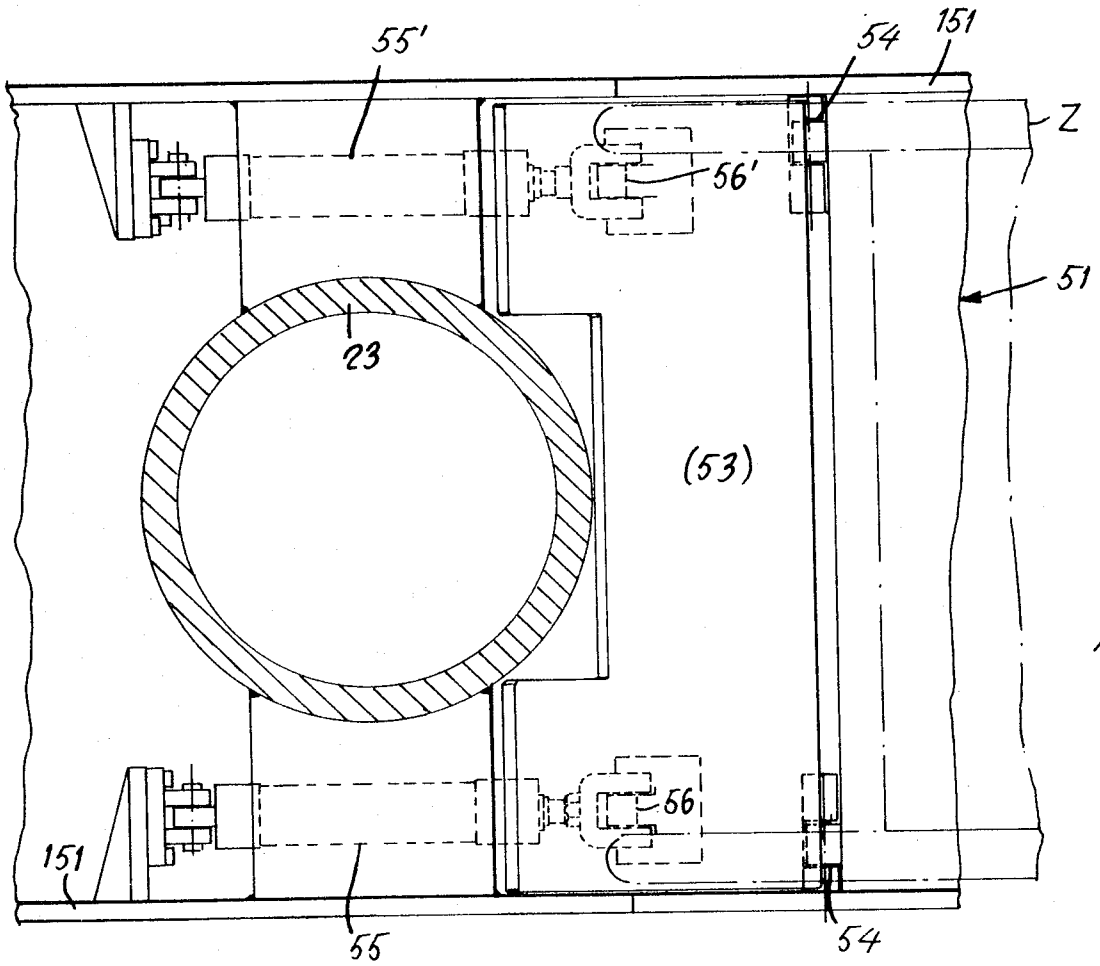
FIG. 8 shows further details of the mechanism according to FIG. 7, in plan view.

For the unloading of the filled spool from the bracket 51 of the robot, there can be provided means located at the station where the spool is unloaded, or means which are associated to the said bracket as shown in FIGS. 7 and 8. These means comprise a pusher plate 53 covering the inclined upper bottom portion of the bracket 51, to which the said pusher plate 53 is transversally fulcrumed at 54. A pair of double-acting jacks 55–55' secured by their cylinder bodies to the side edges 151 of the brackets 51–51' and connected by their stems to lugs 56–56' on the lower side of the pusher plate 53, promote, upon suitable control, the lifting of said pusher plate 53 as shown in dash lines in FIG. 7, so as to cause the pushing of the filled spool Z which is thus discharged from the bracket 51.

With reference to FIGS. 10 to 14, there will now be described the construction and operation of the unit mounted on platform 24 and which provides for: the cutting of the wire fed from the wire winding machines; the holding of the new leading end of said wire; the securing of the trailing end of the wire which has been wound onto the same winding; and lastly the securing of the new leading end of the wire to the core of the empty spool which has been inserted into the winding machine. This unit, which faces the file of wire winding machines, comprises a vertical guide 57 fixed to platform 24 and onto which there is movable vertically a slide 58 which on its turn acts as a guide for another vertical slide 59. The hydraulic jacks 60 and 60' promote the movement of the slides 58 and 59. In the lower portion of the slide 59 there is mounted a head member 61 which carries a freely rotatable roller 62, which is lined with elastic yielding material and is arranged with its axis parallel to the longitudinal axis of track A. To the guide 57 there is secured, in overhanging position, a supporting member 63 which supports in a rotatable manner a bobbin 64 of adhesive tape, which tape is led over rollers 65–65' and lastly over said roller 62, onto which it is kept by a small parallel counter-roller 66 made of metal and presenting annular grooves so as to have a reduced contact surface with the adhesive side of the tape web 64'. The counter-roller 66 is rotatably supported at its ends by arcuate supports 67 (see FIG. 11) which are fulcrumed at 68 to the head member 61 and are interconnected by a transverse bar 69 onto which there acts an adjustable pressure member 70, thus ensuring the required cooperation of counter-roller 66 with roller 62.

Figure 14:
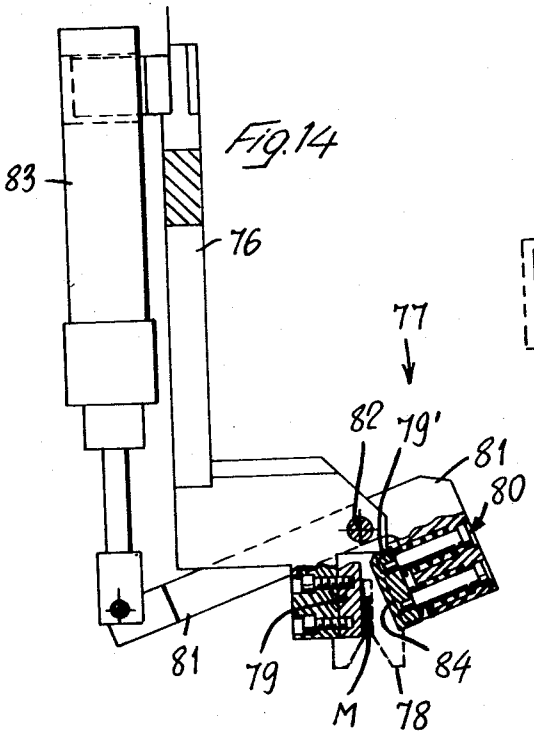
FIG. 14 shows frontally and with parts in section the devices which cut the wire in the wire winding machines, and which simultaneously hold the new leading end of the wire itself.
Figures 10, 12:
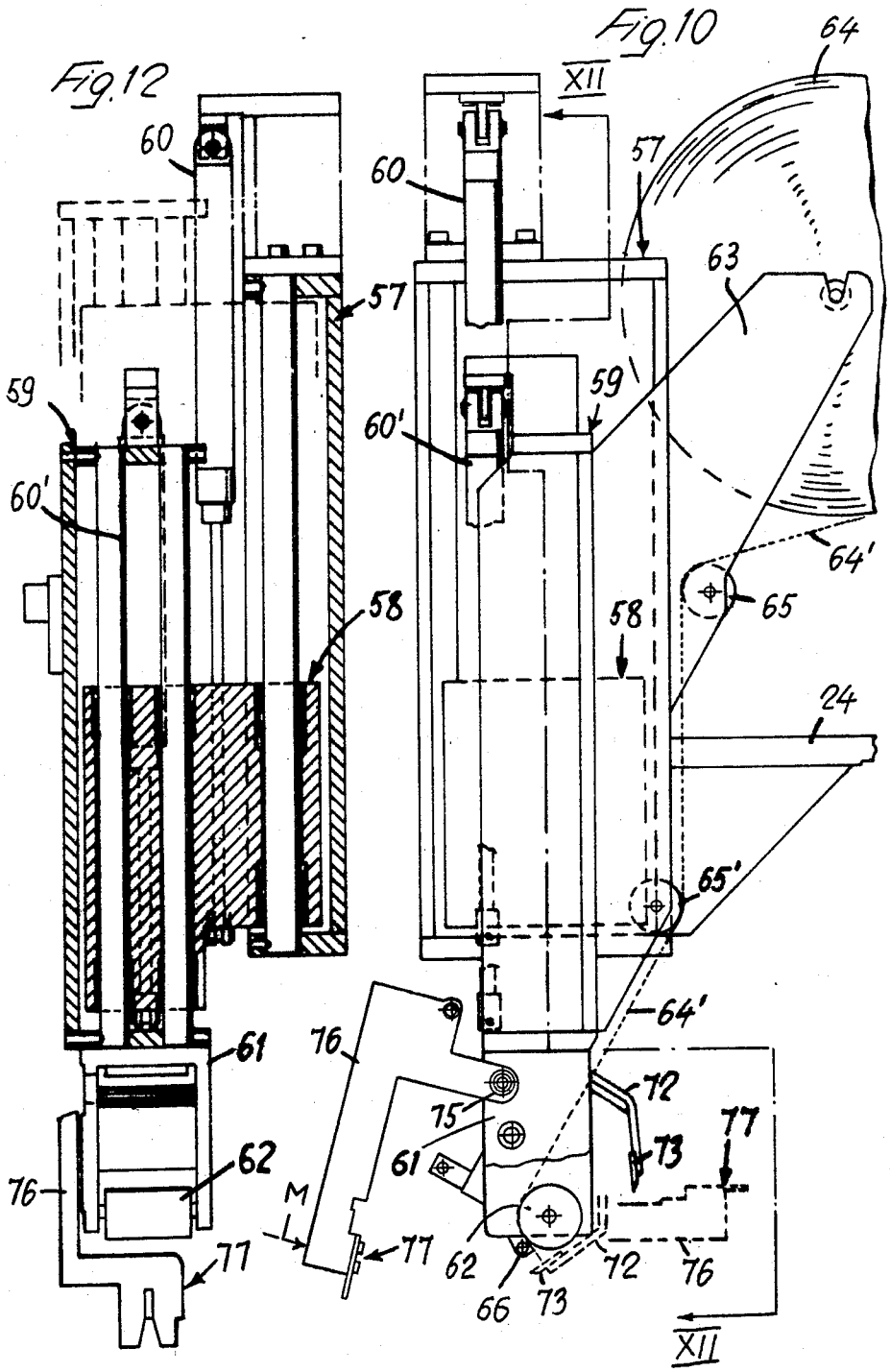
FIGS. 10 and 11 are side elevation views of the devices mounted in the upper portion of the robot, and serving for the cutting and holding of the wire in the wire winding machines, and also for the securing of the trailing end and of the leading end of the winding.
FIG. 12 shows constructional details of the unit of FIG. 10 sectioned along line XII—XII.
Figure 11:
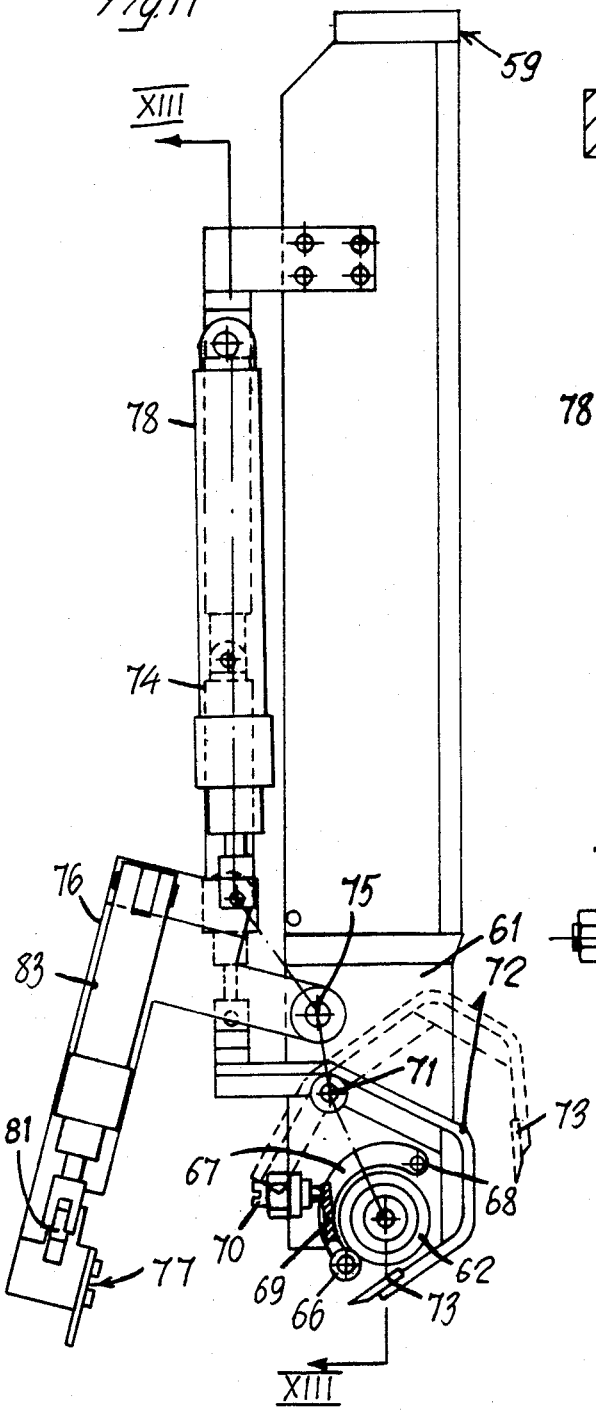
Figure 13:
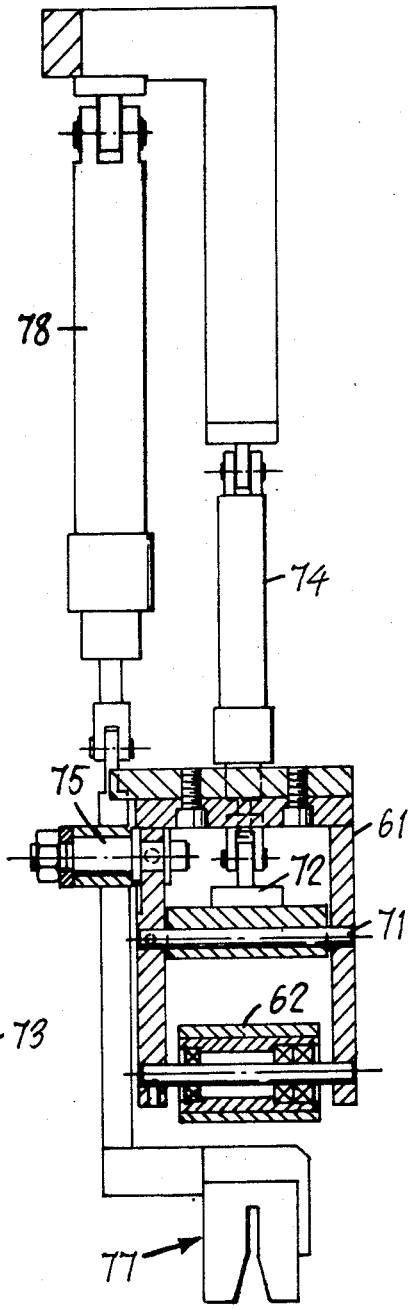
FIG. 13 shows the unit of FIG. 11 sectioned along line XIII—XIII.

Parallel to roller 62 and above same, there is interfulcrumed at 71 an arcuate lever 72 carrying at its end cutting means 73 while its other end is connected to a jack 74 secured to slide 59. Thanks to said jack, the above mentioned cutting means can be brought from the rest position indicated in FIG. 10 with full lines, to the cutting position indicated with dash lines, and vice-versa. Laterally with respect to head member 61, parallel to roller 62 there is fulcrumed at 75 a lever 76 which viewed frontally (FIGS. 12, 13) presents an "L" shape so as to result with its bottom leg parallelly arranged with respect to the axis of the said roller 62 and so as to be able to rotate around said roller. On the bottom leg portion of said lever 76 there are mounted the cutting means 77 (which will be described later) for the cutting of the wire fed to the winding machines and which hold the new leading end of the wire itself. Lever 76, as can be seen from FIG. 11, is connected to a jack 78 which is capable of bringing the same from its rest position (FIG. 10) indicated in full lines, to the position indicated in dash lines, and vice versa. With reference to FIGS. 10 and 15, it can be noted that when the robot bracket 51 is introduced into winding machine B" for extracting the spool Z, the assembly composed of the slides 58,59 is lowered in such a manner that the roller 62 comes into contact with the trailing end of the wire M which has been wound on the said spool, which latter has been held and cut by the holding and cutting means 77. The trailing end of the wire which has been wound on spool Z is caused in this manner to be blocked on the same winding by the pressure of roller 62. At this point there is imparted the control for the rotation of the winding machine in the direction indicated in FIG. 15 by arrow F1, so that a portion of adhesive tape 64' is applied onto the winding of spool Z to block the trailing end of the wire which has been wound. In this phase, the spool Z may be caused to rotate even for more than one full turn. Alternatively, the holding and cutting means 77 can be operated after application of the adhesive tape binding. When, later, the spool Z has been stopped, the assembly comprising the slides 58,59 is lifted, and the cutting means 73 are actuated and separate the adhesive binding applied on the wire winding from the continuous web 64'. The new leading end of wire M is always held by the means 77. In the subsequent step illustrated in FIG. 18, when the robot has inserted the empty spool Z' into the winding machine, the leading end of the wire M is anchored to the core of the empty spool in the following manner. The lever 76 which carries the means 77 is brought into the position indicated in FIG. 10 in dash lines, so that the wire M held by the said means 77 is passed below the roller 62. In this manner, when the assembly of slides 58,59 is lowered, the wire M is pressed onto the core of spool Z' by roller 62 and the leading end of adhesive tape 64'. The means 77 are set at rest position, and the spool Z' is rotated in the direction indicated in FIG. 18 by arrow F1, so that a length of adhesive tape 64' is applied to the core of said spool Z' so as to secure onto it the leading end of wire M. Also during this step the spool Z' may be rotated for one or more turns. When the spool Z' has been stopped, the assembly of slides 58,59 is lifted, and the cutting means 73 (FIG. 10) are actuated in order to separate the continuous web 64' from the binding applied onto the core of spool Z'; thereafter, the means 73 and 77 are again brought to their cycle starting position. Means 77 are illustrated in FIG. 14 and comprise a fork 78 secured to lever 76 and having a leading-in V-shape, so as to lead the wire M between the jaws 79,79' of a clamping device. Of said jaws, the one indicated by reference numeral 79 is fixedly secured to lever 76, while the other jaw 79' is mounted, with the interposition of an elastic assembly 80, on a lever 81 which is fulcrumed at 82 to lever 76 and is connected to a driving jack 83 secured to the said lever 76. On lever 81, rearwardly with respect to the clamping surface of jaw 79', there is secured a cutting blade 84, while an end of the other jaw 79 is used as counterblade. In FIG. 14 means 77 are illustrated in their rest position. It can be easily understood how, by retracting the jack 83, the jaw 79' closes on jaw 79, thus clamping the wire M, and the closing motion of jaw 79', permitted by the elastic assembly 80, promotes the cutting of the same wire by the blade 84.

I claim:

1. A robot device for loading empty spools (Z') and unloading filled spools (Z) respectively into and from wire winding machines (B, B', B'') aligned in a single file on one side of a path (A), comprising a transport carriage (1) movable along said path (A) and carrying a vertical supporting structure (23) onto which are movably mounted at least two brackets (51, 51') for supporting said empty and filled spools (Z', Z), said brackets (51, 51') extending in directions opposite to one another, lifting and lowering devices (46, 46') and rotating devices (31, 32, 33) being provided to promote vertical movement and rotation of said brackets (51, 51') around said vertical supporting structure (23), wherein (a) the winding axes of said wire winding machines (B, B', B''), and consequently the axes of said spools housed in said wire winding machines, are substantially parallel to the longitudinal axis of said path (A) along which said carriage (1) moves, at least in a section of said path (A) facing said wire winding machine arranged at its side;

(b) transverse displacement means (17) are provided on said carriage (1) for moving said vertical supporting structure (23) in a direction which is substantially perpendicular to the longitudinal axis of said path (A) and to the winding axis of said spool (Z) housed in a winding machine (B), whereby unloading of said filled spool (Z) from said winding machine onto a said bracket (51) and loading of said empty spool (Z') from a said bracket into said winding machine are affected by moving said spools (Z, Z') in directions which are perpendicular to said winding axes of said spools;

(c) each bracket (51, 51') has, on its longitudinal sides which are perpendicular to said winding axes of said spools (Z, Z'), side engagement members (151, 151') adapted to engage at least one flange of said spool, said engagement taking place upon controlled movement along said path (A) of said carriage (1) when said brackets are in their lifted position and introduced in said wire winding machine, whereby controlled movement of said carriage (1) in one direction causes freeing of said filled spool (Z) from a center or tailstock (P) of said wire winding machine for unloading of said filled spool onto said bracket, while controlled movement of said carriage (1) in an opposite direction causes engagement of said empty spool (Z') with said center or tailstock (P) of said wire winding machine for loading of said empty spool on said winding machine.

2. A robot device according to claim 1, wherein said controlled movement of said carriage (1) in both directions is delimited by insertion of a movable member (10) mounted on said carriage (1) into a fixed slot-shaped seat (14) arranged on said path (A) of said carriage, movement of said carriage in both directions being determined by the length of said slot-shaped seat.

3. A robot device according to claim 1, wherein on said transport carriage (1) there are further arranged means (77) for cutting the wire (M) fed from said wire winding machine to said filled spool (Z) and for holding a leading end of said wire after the same has been cut, and means (61–73) for securing a trailing end of said wire which has been cut onto the wire winding formed on said filled spool (Z) and for securing said leading end of said wire to a core of said empty spool (Z') which has been subsequently inserted into said winding machine.

4. A robot device according to claim 3, wherein said means (77) for cutting and holding said wire and said means (61–73) for securing said wire are mounted on a platform (24) arranged at the top of said vertical supporting structure (23) carried by said carriage (1), means (58–60) being provided for moving said cutting and holding means and said securing means into and out of their operative range, all of said means being hydraulically powered and controlled by a hydraulic power and control unit (25) located on said platform (24).

5. A robot device according to claim 1, wherein on said transport carriage there are arranged:

(a) an hydraulic motor (7) for moving said carriage (1) along said path (A);

(b) an hydraulically powered unit (46, 46') for vertical movement of said brackets (51, 51');

(c) an hydraulically powered unit (33) for rotational movement of said brackets (51, 51');

(d) an hydraulically powered unit (18) for said transverse displacement means (17); and (e) an hydraulic power and control unit (25) for controlled feeding of all of said hydraulic motors and hydraulically powered units.

6. A robot device according to claim 5, wherein all of said hydraulic motors, hydraulically powered units and said hydraulic power and control unit (25) are located on a platform (24) arranged at the top of said vertical supporting structure (23) carried by said carriage (1).

7. A robot device according to claim 5, further comprising, mounted on each said bracket (51, 51'), a pusher plate (53) for discharge of said filled spool (Z) which has been located onto said bracket from said winding machine, said pusher plate being hydraulically powered and being controlled by said hydraulic power and control unit (25).

8. A robot device according to claim 1, wherein each said bracket (51, 51') is constructed so as to present a substantially horizontal surface for supporting said spools (Z, Z'), said horizontal surface presenting a concavity or shallow recessed portion arranged transversely to the length of said bracket, for stable positioning of said spool carried by said bracket.

9. A robot device according to claim 4, wherein said means for moving said wire cutting and holding means (77) and said wire securing means (61–73) into and out of their operative ranges comprise a vertical guide (57) fixed to said platform (24), onto which guide there is slidably mounted at least one slide (58, 59) carrying at its lower end said wire cutting and holding means (77) and said wire securing means (61–73).

10. A robot device according to claim 9, wherein said wire cutting and holding means (77) comprise a lever (76) fulcrumed at a lower head end of said side (59) and provided at its free end with a clamping device formed by a pair of jaws (79, 79'), one of said clamping jaws carrying also a blade (84) while the other of said clamping jaws acts as a counterblade.

11. A robot device according to claim 10, wherein said wire securing means comprise a roller (62) onto which is passed a web of adhesive tape (64') supplied from a suitably arranged supply bobbin (64), and a blade (73) for cutting said adhesive tape (64') mounted on a lever (72) fulcrumed at a lower head end of said slide (59), whereby, when a filed spool (Z) must be unloaded from said wire winding machine, said wire cutting means (77) cut the wire (M) being fed to said spool and hold said leading end of said wire which has been cut, while said wire securing means (61–73) apply a suitable length of adhesive tape (64') to block and said trailing end of said wire on said winding formed on said filled spool by suitably pressing said roller (62) on said winding, said adhesive web being subsequently cut by said blade (73), and, when an empty spool (Z') is inserted in said wire winding machine, said lever (76) carrying said leading end of said wire is swung so as to bring said wire in contact with said roller (62) carrying said adhesive tape (64'), said roller (62) being subsequently pressed onto said core of said empty spool (Z') which is then rotated, so as to apply a suitable length of adhesive tape with said wire interposed and to secure said leading end of said wire on said core of said empty spool.

* * * * *